US009494897B2

(12) United States Patent
Kikushima

(10) Patent No.: US 9,494,897 B2
(45) Date of Patent: Nov. 15, 2016

(54) FIXING DEVICE HAVING A COOLING DEVICE FOR A PRESSURE MEMBER

(71) Applicant: Yuuki Kikushima, Kanagawa (JP)

(72) Inventor: Yuuki Kikushima, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/133,885

(22) Filed: Dec. 19, 2013

(65) Prior Publication Data

US 2014/0199090 A1 Jul. 17, 2014

(30) Foreign Application Priority Data

Jan. 17, 2013 (JP) ..... 2013-006214

(51) Int. Cl.
*G03G 15/20* (2006.01)

(52) U.S. Cl.
CPC ..... *G03G 15/2053* (2013.01); *G03G 15/206* (2013.01); *G03G 2215/2032* (2013.01)

(58) Field of Classification Search
CPC ..... G03G 15/2017; G03G 15/2042
USPC ..... 399/69, 92, 334
See application file for complete search history.

(56) References Cited

U.S. PATENT DOCUMENTS

| | | | | |
|---|---|---|---|---|
| 5,550,621 | A * | 8/1996 | Ogawahara | 399/69 |
| 5,787,321 | A * | 7/1998 | Nishikawa et al. | 399/69 |
| 2004/0190925 | A1* | 9/2004 | Baruch et al. | 399/69 |
| 2006/0140662 | A1* | 6/2006 | Nagase | 399/92 |
| 2006/0198670 | A1* | 9/2006 | Baba et al. | |
| 2007/0059021 | A1* | 3/2007 | Hanashi et al. | 399/92 |
| 2008/0025746 | A1* | 1/2008 | Kanai | 399/69 |
| 2008/0124146 | A1* | 5/2008 | Bae et al. | |
| 2011/0142480 | A1* | 6/2011 | Miyata et al. | 399/92 |
| 2011/0222890 | A1 | 9/2011 | Kikushima et al. | |
| 2012/0155906 | A1* | 6/2012 | Barton | 399/69 |

(Continued)

FOREIGN PATENT DOCUMENTS

| | | |
|---|---|---|
| JP | H-01-279278 A | 11/1989 |
| JP | 10-048981 | 2/1998 |

(Continued)

OTHER PUBLICATIONS

Office Action dated Aug. 9, 2016 for Japanese Patent Application No. 2013-006214.

*Primary Examiner* — Walter L Lindsay, Jr.
*Assistant Examiner* — Milton Gonzalez
(74) *Attorney, Agent, or Firm* — Harness, Dickey & Pierce, P.L.C.

(57) ABSTRACT

A fixing device includes a heating roller, a fixing roller, an endless fixing belt, a pressure roller, a temperature gauge, and a cooling device. The fixing belt is stretched between the heating roller and the fixing roller. The pressure roller includes a core rod and an elastic layer formed on an outer circumferential surface of the core rod, and is pressed against the fixing roller via the fixing belt to form a nip portion to thermally fix an image on a recording medium passed through the nip portion. The temperature gauge measures the surface temperature of the pressure roller. The cooling device includes plural cooling units arranged parallel to a rotation axis of the pressure roller, and cools the pressure roller while adjusting the amount of cooling for each of the cooling units in accordance with the surface temperature of the pressure roller measured by the temperature gauge.

12 Claims, 8 Drawing Sheets

(56) References Cited

U.S. PATENT DOCUMENTS

| | | | | |
|---|---|---|---|---|
| 2012/0263507 | A1 | 10/2012 | Kikushima et al. | |
| 2014/0023389 | A1* | 1/2014 | Ono | 399/69 |
| 2015/0063858 | A1 | 3/2015 | Nakamura et al. | |

FOREIGN PATENT DOCUMENTS

| | | | | |
|---|---|---|---|---|
| JP | 2000-267495 | | | 9/2000 |
| JP | 2009-251156 | | | 10/2009 |
| JP | 2010181468 | A | * | 8/2010 |
| JP | 2010-266705 | | | 11/2010 |
| JP | 2011-123198 | A | | 6/2011 |
| JP | 2011-215581 | | | 10/2011 |
| JP | 2012-083434 | | | 4/2012 |
| JP | 2013-190627 | A | | 9/2013 |

* cited by examiner

FIXING DEVICE HAVING A COOLING DEVICE FOR A PRESSURE MEMBER

CROSS-REFERENCE TO RELATED APPLICATION

This patent application is based on and claims priority pursuant to 35 U.S.C. §119 to Japanese Patent Application No. 2013-006214, filed on Jan. 17, 2013, in the Japan Patent Office, the entire disclosure of which is hereby incorporated by reference herein.

BACKGROUND

1. Technical Field

The present invention relates to a fixing device.

2. Related Art

A typical electrophotographic image forming apparatus includes a fixing device for fixing a toner image on a recording medium such as a transfer sheet. In the fixing device, the recording medium passes through a nip portion formed by, for example, a heated rotating fixing member (e.g., a fixing roller or belt) and a rotating pressure member (e.g., a pressure roller) pressed against the fixing member. Thereby, toner of the toner image carried on the recording medium is fused, and the toner image is fixed on the recording medium.

The pressure roller usually has an outer circumferential layer made of a material having at least a certain level of frictional resistance and elasticity, such as rubber or resin. If the outer circumferential layer is made of a material that expands and contracts with temperature, the outer diameter of the pressure roller changes. This change in outer diameter is particularly prominent in a pressure roller made with an elastic layer of increased thickness, as is commonly done to reduce crumpling and misregistration of the recording medium on which the toner image is to be fixed when the recording medium is comprised of a plurality of superimposed sheets such as envelopes, for example.

Further, if recording media of different sizes pass through the pressure roller, it is difficult to maintain a uniform temperature distribution in the direction of the rotation axis of the pressure roller. A difference in temperature occurs between a recording medium passing region and recording medium non-passing regions of the pressure roller, causing a difference in thermal expansion therebetween, which results in distortion of the pressure roller.

The fixing device may be configured to suppress an increase in temperature of the recording medium non-passing regions due to the passage of many small-sized recording media through the pressure roller, and thereby prevent hot offset (i.e., adhesion of excessively fussed toner to components of the fixing device) and deterioration of the pressure roller, for example.

That is, the fixing device may be configured to include a heating roller, a pressure roller pressed against the heating roller to thermally fix a toner image on a recording medium passed through between the rollers, and a cooling device that cools the recording medium non-passing regions of the pressure roller, through which the small-sized recording media do not pass. Specifically, the cooling unit may be, for example, a blower capable of controlling the amount of air to be blown onto the recording medium non-passing regions.

However, if the pressure roller including the above-described thick elastic layer, storing a large amount of heat, and having an uneven temperature distribution is cooled with a constant amount of air blown onto the pressure roller, the change in outer diameter of the pressure roller due to the change in temperature varies in the rotation axial direction, making it difficult to maintain the shape of the pressure roller. Particularly if the pressure roller has a constricted shape including opposed end portions and a central potion smaller in diameter than the opposed end portions, it is difficult to maintain the difference between the maximum diameter of the pressure roller at the opposed end portions and the minimum diameter of the pressure roller at the central portion.

SUMMARY

The present invention provides an improved fixing device that, in one example, includes a heating roller, a fixing roller, an endless fixing belt, a pressure roller, a temperature gauge, and a cooling device. The fixing belt is stretched between the heating roller and the fixing roller. The pressure roller includes a core rod and an elastic layer formed on an outer circumferential surface of the core rod, and is pressed against the fixing roller via the fixing belt to form a nip portion between the pressure roller and the fixing belt to thermally fix an image on a recording medium passed through the nip portion. The temperature gauge measures the surface temperature of the pressure roller. The cooling device includes plural cooling units arranged parallel to a rotation axis of the pressure roller, and cools the pressure roller while adjusting the amount of cooling for each of the cooling units in accordance with the surface temperature of the pressure roller measured by the temperature gauge.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION

Figure 1:
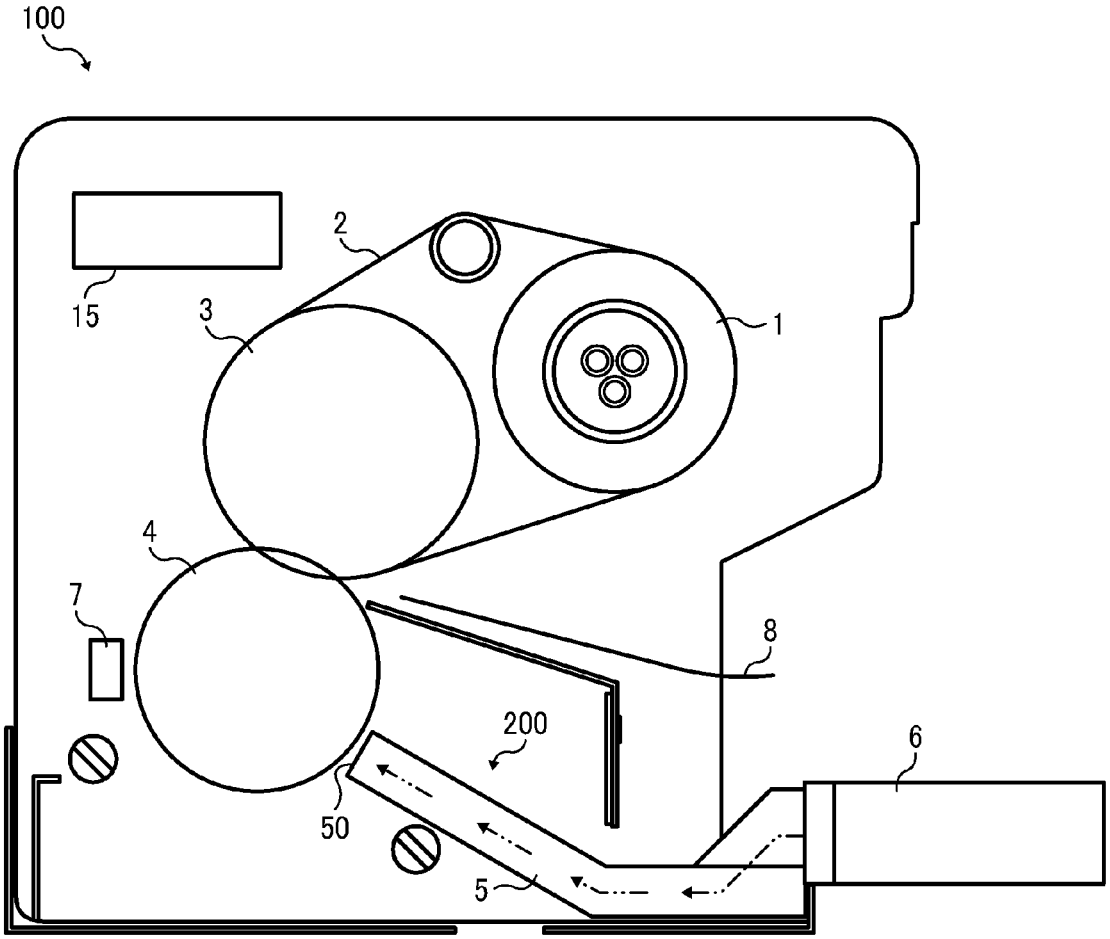
FIG. 1 is a cross-sectional view of a configuration example of a fixing device according to a first embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, fixing devices according to embodiments of the present invention will be described.

A first embodiment of the present invention will now be described. FIG. 1 is a cross-sectional view of the configuration of a fixing device 100 according to the first embodiment. As illustrated in FIG. 1, the fixing device 100 includes at least a heating roller 1, a fixing roller 3, an endless fixing belt 2, a pressure roller 4, a temperature gauge 7, a controller 15, and a cooling device 200 including a plurality of cooling ducts 5, a plurality of cooling units 50, and a blower 6.

The fixing belt 2 is stretched taut around the heating roller 1 and the fixing roller 3. The pressure roller 4 is disposed to be pressed against the fixing roller 3 via the fixing belt 2. The pressure roller 4 includes a core rod and an elastic layer formed on the outer circumferential surface of the core rod. The temperature gauge 7 measures the surface temperature of the pressure roller 4. The cooling device 200 cools the pressure roller 4. The fixing device 100 thermally fixes an image on a recording medium 8 passed through a nip portion formed between the fixing belt 2 and the pressure roller 4 (i.e., a nip portion formed between the fixing roller 3 and the pressure roller 4 via the fixing belt 2).

In the cooling device 200, the cooling units 50 are arranged parallel to the rotation axis of the pressure roller 4. In accordance with respective surface temperatures of a plurality of portions of the pressure roller 4 measured by the temperature gauge 7, the amount of cooling (e.g., the amount of cooling air to be blown) is adjusted for each of the cooling units 50.

The cooling device 200 illustrated in FIG. 1 is a cooler in which cooling air blown from the cooling blower 6 is guided by the cooling ducts 5 and blown onto the pressure roller 4. The cooling units 50 correspond to respective open end portions of the cooling ducts 5 serving as blow-off ports through which the cooling air is blown onto the pressure roller 4.

The cooling device 200 may be configured to guide the cooling air from a plurality of cooling blowers to a plurality of corresponding cooling ducts, or to distribute the cooling air from a single cooling blower to a plurality of cooling ducts. Either configuration may be selected depending on the desired cooling performance. In the cooling device 200 of the present embodiment, the cooling blower 6 is subdivided into a plurality of cooling blowers, as described later.

Figure 2A:
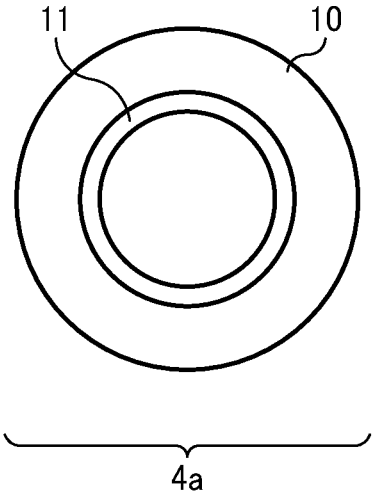
FIGS. 2A and 2B are schematic cross-sectional views of configuration examples of layers of a pressure roller applicable to the fixing device illustrated in FIG. 1.
Figure 2B:
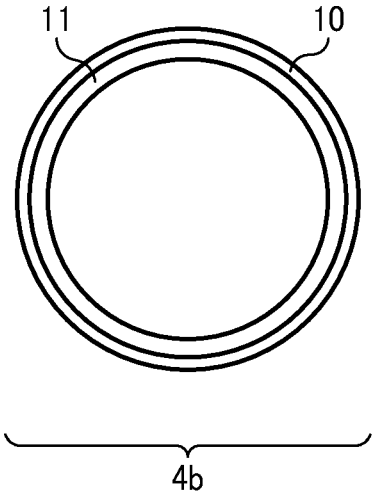

FIGS. 2A and 2B are cross-sectional views of examples of the pressure roller 4. The pressure roller 4 is configured to include a cylindrical core rod 11 and an elastic layer 10 laminated on the outer circumferential surface of the core rod 11. FIG. 2A illustrates a pressure roller 4*a* in which the elastic layer 10 is thicker than any other layer forming the pressure roller 4 (hereinafter referred to as the thick pressure roller 4*a*). FIG. 2B illustrates a pressure roller 4*b* commonly used in fixing devices (hereinafter referred to as the normal pressure roller 4*b*).

In the thick pressure roller 4*a*, the elastic layer 10 has a thickness of approximately 10 mm to approximately 15 mm, for example. By contrast, in the normal pressure roller 4*b*, the elastic layer 10 has a thickness of approximately 2 mm, for example. The diameter of the core rod 11 is smaller in the thick pressure roller 4*a* than in the normal pressure roller 4*b*.

The fixing device 100 of the present embodiment effectively suppresses an uneven change in outer diameter of the pressure roller 4 due to a change in temperature in the cooling operation, particularly when the pressure roller 4 is the thick pressure roller 4*a* having a large amount of thermal expansion and storing a large amount of heat.

Further, the fixing device 100 of the present embodiment effectively suppresses the uneven change in outer diameter of the pressure roller 4 due to the change in temperature in the cooling operation, particularly when the pressure roller 4 has a constricted shape in the direction of the rotation axis, including opposed end portions and a central portion smaller in diameter than the opposed end portions.

Figure 3:
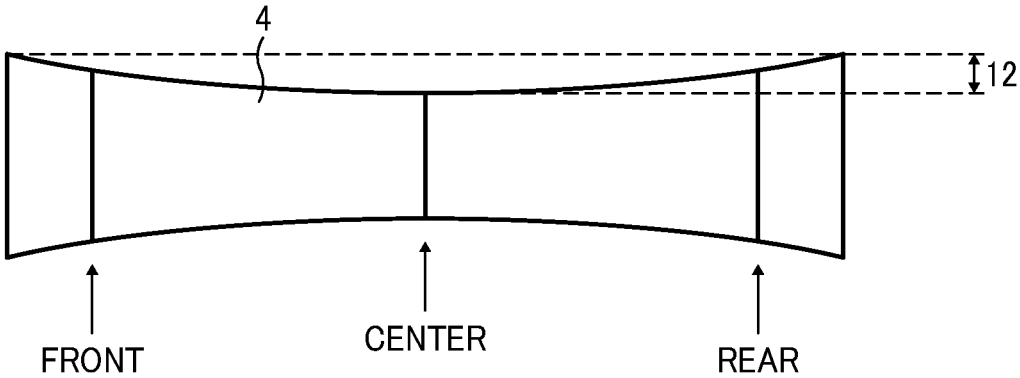
FIG. 3 is a cross-sectional view in the longitudinal direction of an example of the pressure roller.

FIG. 3 is a cross-sectional view in the longitudinal direction of the pressure roller 4 having the constricted shape. FIG. 3 illustrates a central portion and opposed end portions (i.e., front and rear portions) of a recording medium passing region of the pressure roller 4 through which the recording medium 8 passes. As illustrated in FIG. 3, the pressure roller 4 is smaller in diameter at the central portion than at the opposed end portions. A reference numeral 12 represents the difference between the maximum diameter of the pressure roller 4 at the opposed ends thereof and the minimum diameter of the pressure roller 4 at the center thereof.

Figure 4:
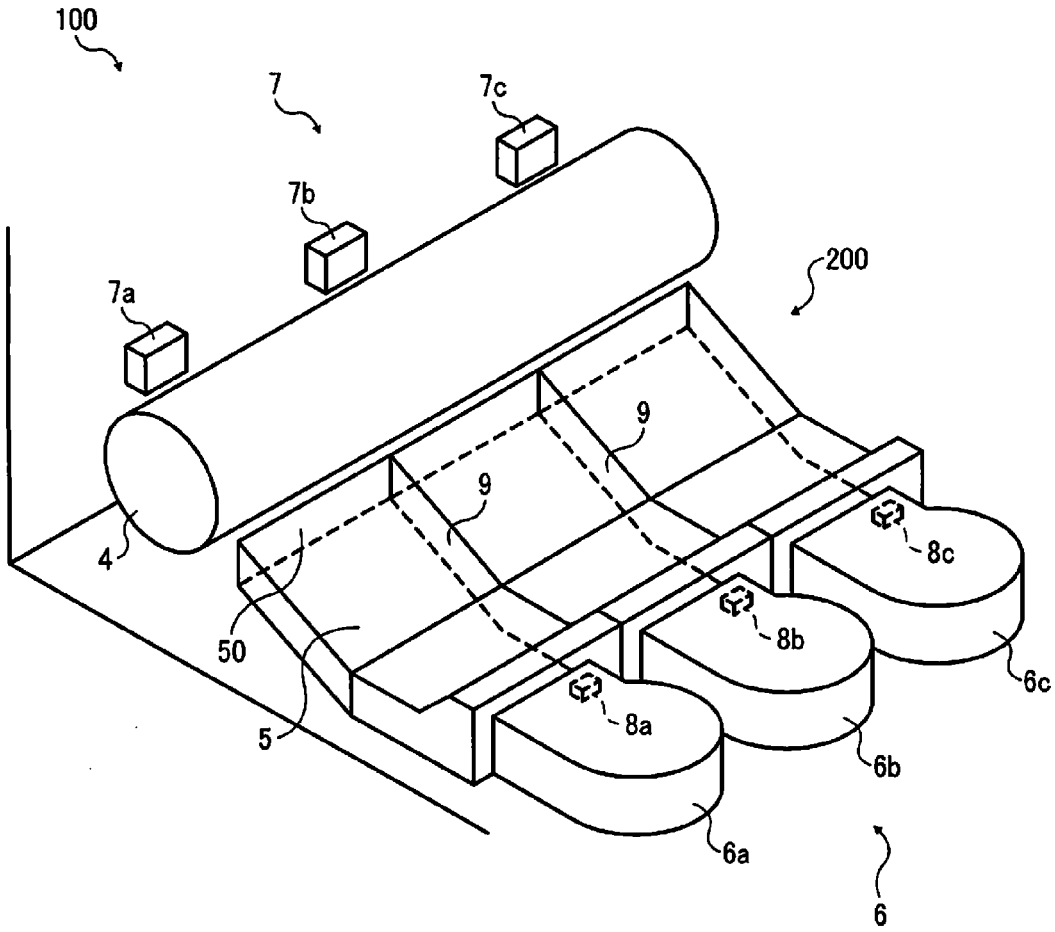
FIG. 4 is a perspective view illustrating the configuration example of the fixing device according to the first embodiment of the present invention.

FIG. 4 is a perspective view of the fixing device 100 according to the first embodiment. As illustrated in FIG. 4, the cooling blower 6 includes a plurality of cooling blowers, i.e., a front cooling blower 6*a*, a central cooling blower 6*b*, and a rear cooling blower 6*c* for blowing the cooling air onto the pressure roller 4. Further, the temperature gauge 7 includes a plurality of sensors, i.e., a front sensor 7*a*, a central sensor 7*b*, and a rear sensor 7*c* for measuring the surface temperatures of the plurality of portions of the pressure roller 4. Further, the cooling ducts 5 are divided by cooling duct dividers 9.

As illustrated in FIG. 4, the cooling device 200 is configured to guide the cooling air from the front cooling blower 6*a*, the central cooling blower 6*b*, and the rear cooling blower 6*c* to the corresponding cooling ducts 5 and blow the cooling air onto the pressure roller 4. In accordance with the surface temperatures of the plurality of portions of the pressure roller 4 measured by the front sensor 7*a*, the central sensor 7*b*, and the rear sensor 7*c* of the temperature gauge 7, the amount of cooling is adjusted for each of the cooling units 50 serving as the blow-off ports by the controller 15, which includes a central processing unit (CPU), a random access memory (RAM), and a read only memory (ROM), for example.

In the present embodiment, the amount of cooling corresponds to the amount of the cooling air to be blown. For example, the amount of cooling may be represented by the amount of the cooling air blown per unit time or the duration of blowing of the cooling air.

If conditions (e.g., temperature, humidity, and components) of air (i.e., gas) used as the cooling air change, however, the relationship between the amount of the cooling air to be blown and the amount of cooling also changes. In this case, therefore, it is necessary to adjust the amount of the cooling air to be blown in order to obtain the amount of cooling according to the above-described conditions. Such adjustment may be performed by, for example, adjusting the amount of the cooling air blown per unit time or the duration of blowing of the cooling air in accordance with the temperature and humidity of the cooling air measured by sensors 8*a*, 8*b*, 8*c* provided inside the cooling blower 6 and near the exit thereof (as shown in FIG. 4), or in accordance with the temperature of the cooling air measured by the temperature gauge 7 after blowing a constant amount of cooling air upon start of the fixing device 100.

As described above, the cooling units 50 serving as the blow-off ports from which the cooling air is blown onto the pressure roller 4 are openings of the cooling ducts 5 divided by the cooling duct dividers 9. The cooling air from the front cooling blower 6*a*, the central cooling blower 6*b*, and the rear cooling blower 6*c* of the cooling blower 6 is sent to the respective openings of the corresponding cooling ducts 5. The amount of the cooling air to be blown is adjusted for each of the cooling units 50 on the basis of the surface temperatures of the pressure roller 4 measured by the front sensor 7*a*, the central sensor 7*b*, and the rear sensor 7*c*.

In a cold state of the pressure roller 4, the cooling device 200 does not cool the pressure roller 4. Specifically, in a cold state in which the surface temperatures of the pressure roller 4 measured by the front sensor 7*a*, the central sensor 7*b*, and the rear sensor 7*c* are below a predetermined temperature (e.g., 60° C.), i.e., the pressure roller 4 is not heated up to the predetermined temperature, the cooling device 200 does not blow the cooling air onto the pressure roller 4.

Figure 5:
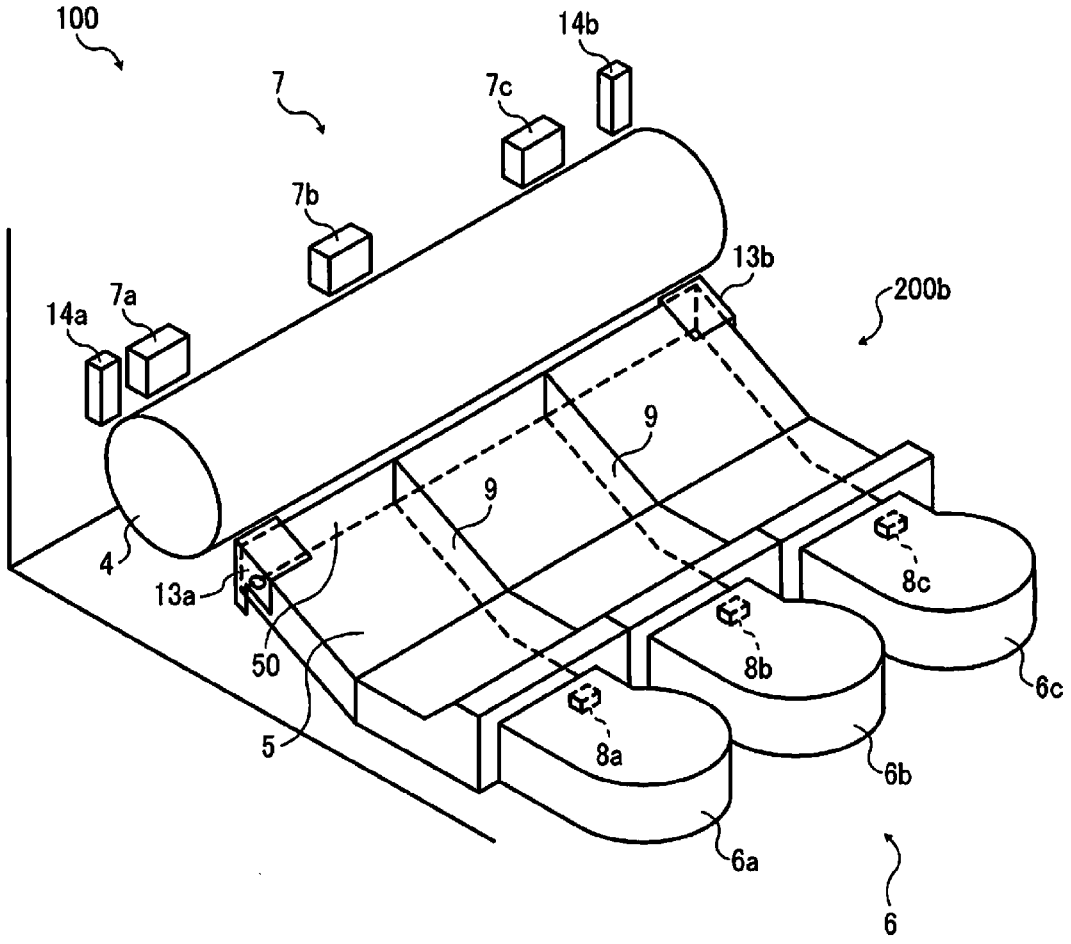
FIG. 5 is a perspective view illustrating a configuration example of a fixing device according to a second embodiment of the present invention.

A second embodiment of the present invention will now be described. FIG. 5 is a perspective view of a fixing device 100*b* according to the second embodiment including a cooling device 200*b*. As illustrated in FIG. 5, the fixing device 100*b* of the present embodiment further includes openably closable shielding devices 13*a* and 13*b* included in the cooling device 200*b* and sensors 14*a* and 14*b* that measure the surface temperatures of opposed end portions of the pressure roller 4.

The shielding devices 13*a* and 13*b* are members that open and close in accordance with the surface temperatures of a plurality of portions of the pressure roller 4 measured by the temperature gauge 7 and the sensors 14*a* and 14*b* also serving as temperature gauges, to thereby change the amount of the cooling air to be blown from the cooling units 50.

In the example illustrated in FIG. 5, the shielding devices 13*a* and 13*b* are disposed on the cooling units 50 corresponding to the opposed end portions of the pressure roller 4, and are controlled to open and close in accordance with the surface temperatures of the opposed end portions of the pressure roller 4 measured by the sensors 14*a* and 14*b*. Each of the shielding devices 13*a* and 13*b* is not particularly limited, and may be any member capable of covering a part or the entirety of the corresponding cooling unit 50, such as a member having a shutter mechanism, for example.

In a normal cooling operation, the shielding devices 13*a* and 13*b* are open. If it is detected by the sensors 14*a* and 14*b* that the surface temperatures of the opposed end portions of the pressure roller 4 have dropped below a predetermined temperature, the shielding devices 13*a* and 13*b* are driven to at least partially close the corresponding cooling units 50. With the shielding devices 13*a* and 13*b* thus closed, the amount of the cooling air to be blown from the cooling units 50 is reduced, thereby preventing unnecessary cooling of the opposed end portions of the pressure roller 4 and thus an unnecessary change (i.e., reduction) in outer diameter of the end portions of the pressure roller 4.

Even if the cooling blower 6 of the cooling device 200*b* is configured as a single cooling blower (i.e., not subdivided into a plurality of cooling blowers), the amount of the cooling air to be blown from the cooling units 50 is easily controllable with the shielding devices 13*a* and 13*b*. Particularly if the change in shape of the pressure roller 4 in the direction of the rotation axis is small, it is possible to adjust the amount of cooling only by the opening and closing operation of the shielding devices 13*a* and 13*b* and thereby suppress the uneven change in outer diameter of the pressure roller 4.

Figure 6:
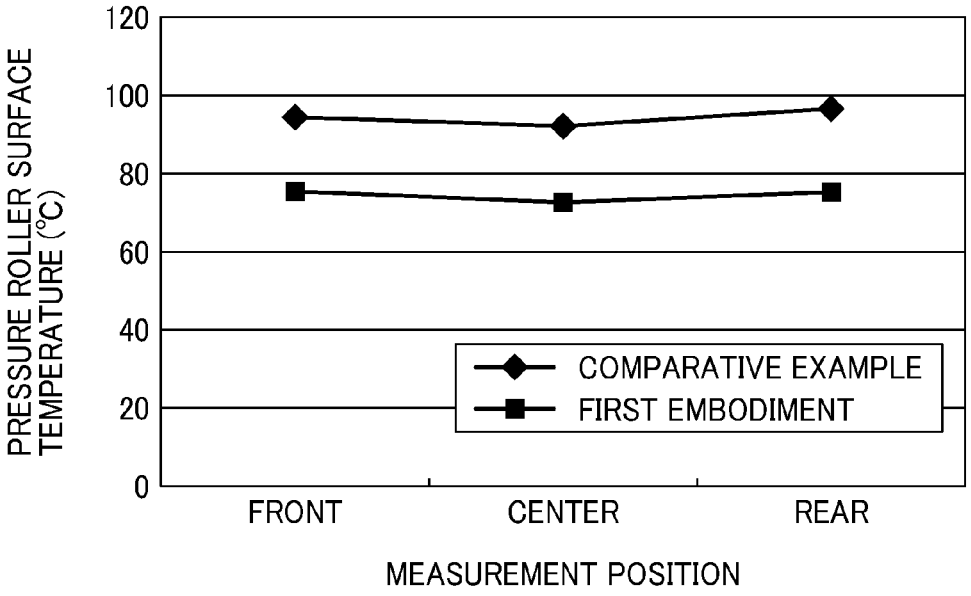
FIG. 6 is a graph illustrating changes in surface temperature of the pressure roller in the fixing device according to the first embodiment and a fixing device according to a comparative example.
Figure 7:
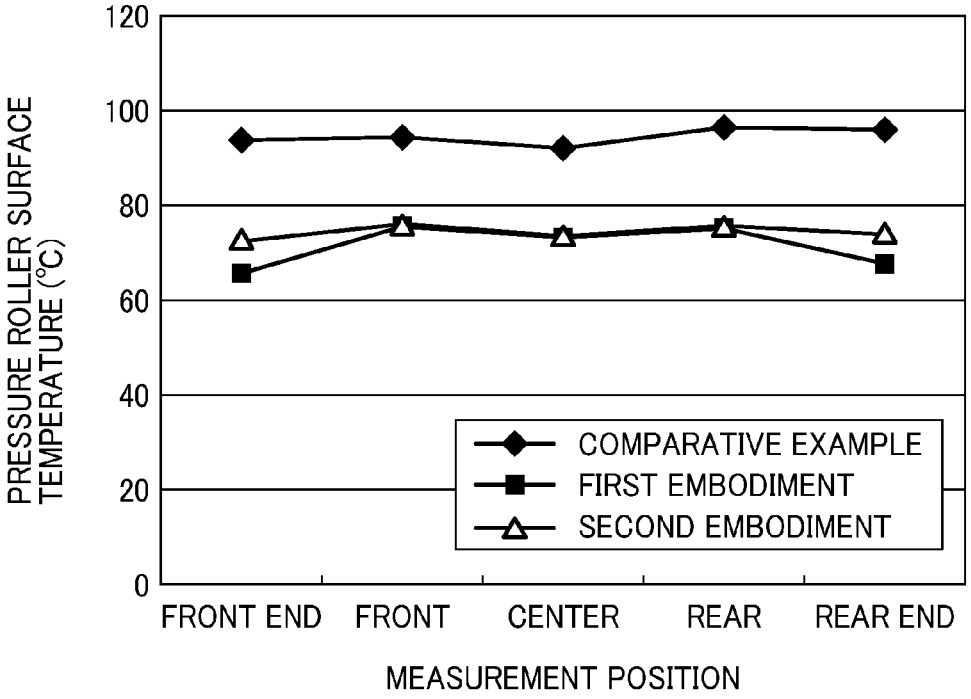
FIG. 7 is a graph illustrating changes in surface temperature of the pressure roller in the fixing device according to the first embodiment, the fixing device according to the second embodiment, and the fixing device according to the comparative example.

FIGS. 6 and 7 illustrate changes in surface temperature of the pressure roller 4 in the fixing device 100 according to the first embodiment, the fixing device 100*b* according to the second embodiment, and a fixing device according to a comparative example not including a cooling device.

FIG. 6 illustrates the surface temperatures of three portions of the pressure roller 4, i.e., the front portion, the central portion, and the rear portion illustrated in FIG. 3, measured when the temperature in the fixing device was stabilized after continuously printing evaluation charts on A4-size sheets in an image forming apparatus including the fixing device.

In FIG. 6, a black square represents the measurement result of the fixing device 100 according to the first embodiment including the cooling device 200, and a black rhombus represents the measurement result of an existing fixing device not including a cooling device. The pressure roller 4 used in these fixing devices has the same configuration.

As illustrated in FIG. 6, the surface temperature of the pressure roller 4 is lower in the fixing device 100 of the first embodiment than in the existing fixing device by approximately 20° C. due to the cooling operation performed by the fixing device 100 of the first embodiment. Further, it is understood from FIG. 6 that the fixing device 100 of the first embodiment is capable of uniformly cooling the pressure roller 4 with little variation in temperature drop among the front portion, the central portion, and the rear portion of the pressure roller 4.

FIG. 7 illustrates the surface temperatures of five portions of the pressure roller 4, i.e., the front portion, the central portion, and the rear portion illustrated in FIG. 3 and a front end portion and a rear end portion located outside the front portion and the rear portion, respectively. The surface temperatures of the five portions were measured when the temperature in the fixing device was stabilized after continuously printing evaluation charts on A4-size sheets in an image forming apparatus including the fixing device.

In FIG. 7, a white triangle represents the measurement result of the fixing device 100*b* according to the second embodiment including the cooling device 200*b* equipped with the shielding devices 13*a* and 13*b*, and a black square represents the measurement result of the fixing device 100 according to the first embodiment including the cooling device 200 unequipped with the shielding devices 13*a* and 13*b*. Further, a black rhombus represents the measurement result of the existing fixing device not including a cooling device. The pressure roller 4 used in these fixing devices are the same in configuration.

As illustrated in FIG. 7, the surface temperature of the pressure roller 4 is lower in the fixing device 100 of the first embodiment and the fixing device 100*b* of the second embodiment than in the existing fixing device by approximately 20° C., similarly to the results of FIG. 6, due to the cooling operation performed by the fixing device 100 of the first embodiment and the fixing device 100*b* of the second embodiment. In the first embodiment not including the shielding devices 13*a* and 13*b*, however, the front end portion and the rear end portion are unnecessarily cooled by the cooling air blown thereto, and thus are lower in surface temperature than those of the second embodiment including the shielding devices 13*a* and 13*b* by approximately 6° C. to approximately 7° C. Accordingly, it is understood that the fixing device 100*b* of the second embodiment including the shielding devices 13*a* and 13*b* is capable of more uniformly cooling the pressure roller 4 with less variation in temperature drop among the portions of the pressure roller 4.

Figure 8:
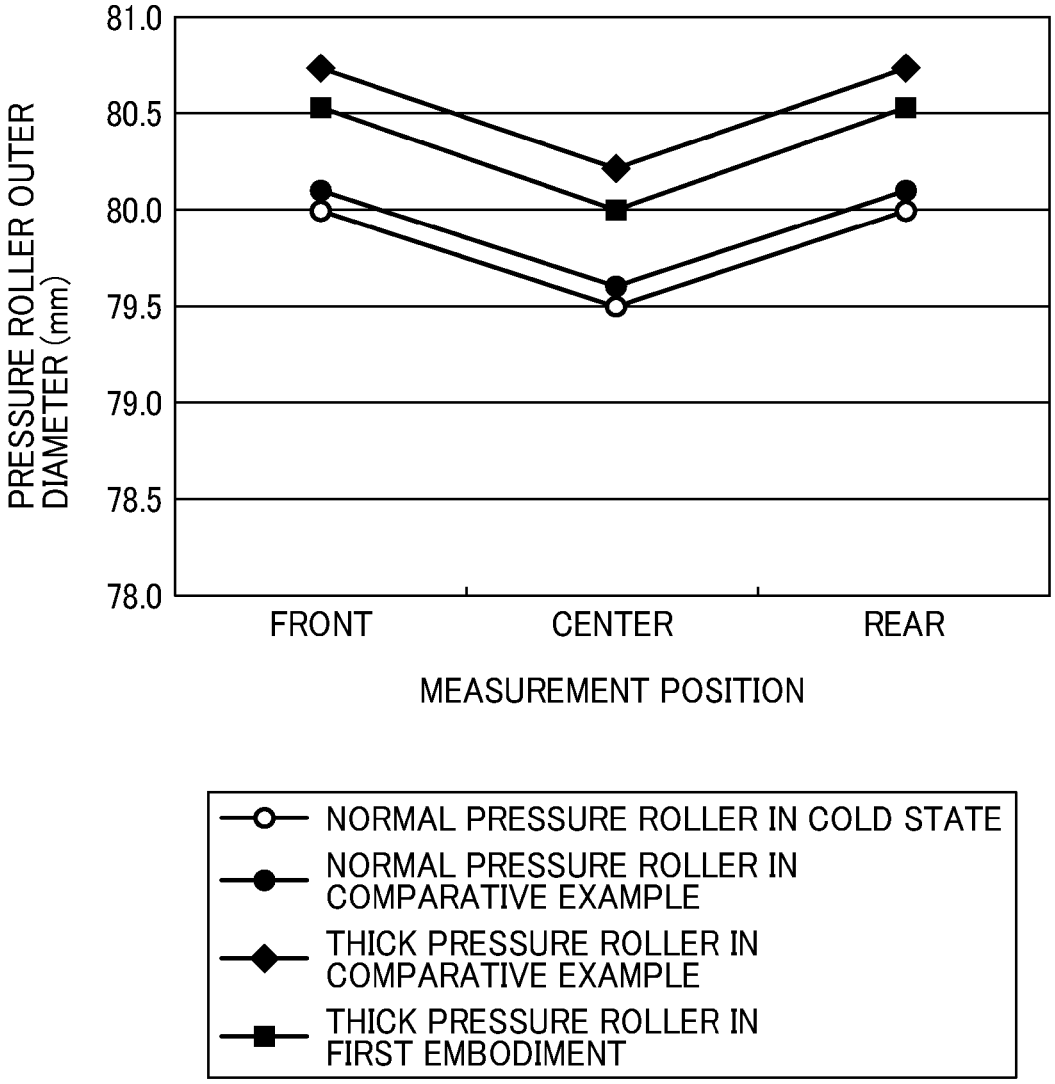
FIG. 8 is a graph illustrating changes in outer diameter of the pressure roller in the fixing device according to the first embodiment and fixing devices according to comparative examples.
Figure 9:
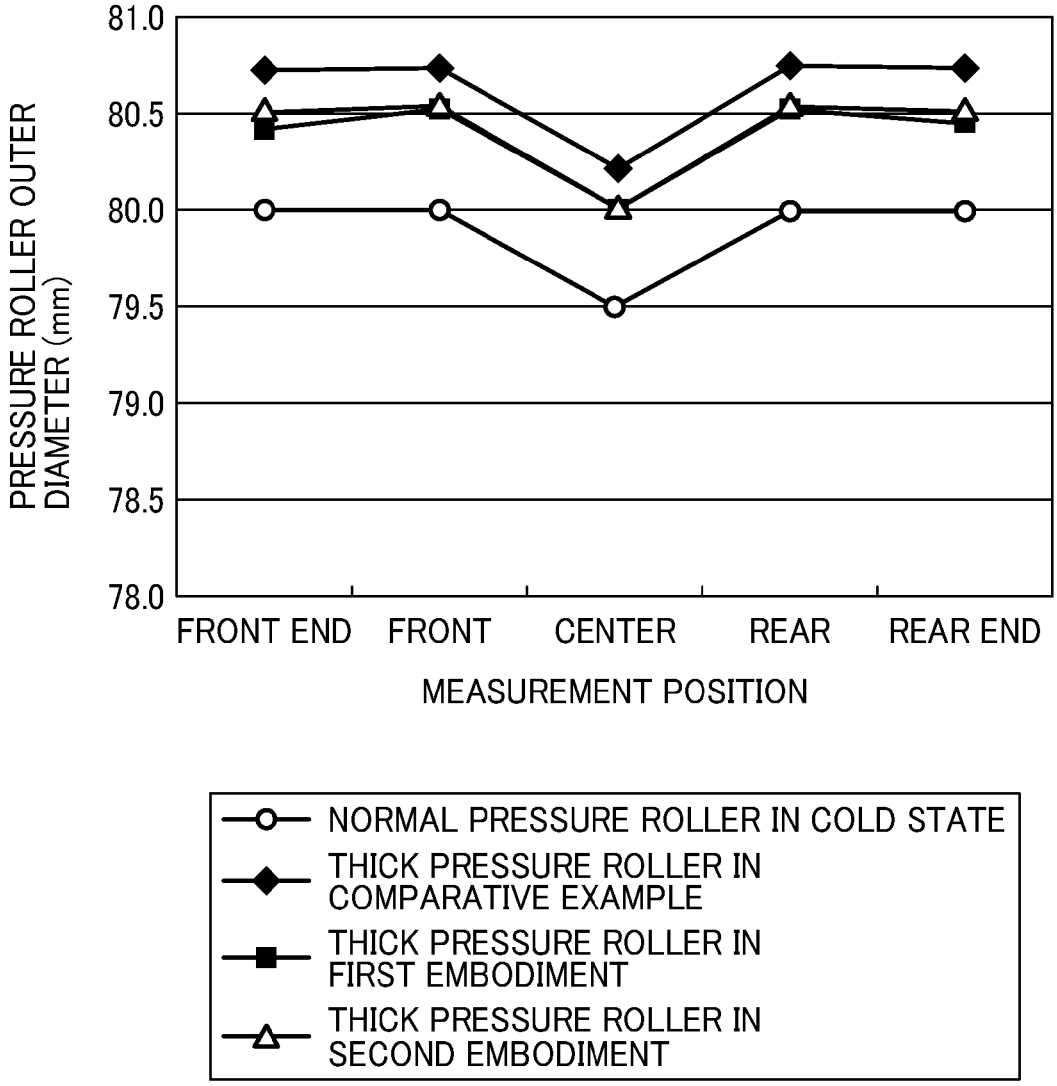
FIG. 9 is a graph illustrating changes in outer diameter of the pressure roller in the fixing device according to the first embodiment, the fixing device according to the second embodiment, and fixing devices according to comparative examples.

FIGS. 8 and 9 illustrate changes in outer diameter of the pressure roller 4 in the fixing device 100 according to the first embodiment, the fixing device 100*b* according to the second embodiment, and fixing devices according to comparative examples not including a cooling device.

FIG. 8 illustrates the outer diameters of the three portions of the pressure roller 4, i.e., the front portion, the central portion, and the rear portion illustrated in FIG. 3, measured when the temperature in the fixing device was stabilized after continuously printing evaluation charts on A4-size sheets in an image forming apparatus including the fixing device.

In FIG. 8, a black square represents the measurement result of the fixing device 100 according to the first embodiment including the pressure roller 4 corresponding to the thick pressure roller 4*a* with the thick elastic layer 10 illustrated in FIG. 2A and the cooling device 200. A black rhombus represents the measurement result of an existing fixing device including the pressure roller 4 corresponding to the thick pressure roller 4*a* and not including a cooling device. A black circle represents the measurement result of an existing fixing device including the pressure roller 4 corresponding to the normal pressure roller 4*b* illustrated in FIG. 2B and not including a cooling device. These measurement results are the outer diameters of the pressure roller 4 measured in a hot state after the above-described continuous printing. Meanwhile, a white circle represents the measurement result of the existing fixing device including the pressure roller 4 corresponding to the normal pressure roller 4*b* obtained by measuring the outer diameter of the pressure roller 4 in a cold state at a temperature of 25° C.

As illustrated in FIG. 8, the thick pressure roller 4*a* with the thick elastic layer 10 is larger in expansion amount and outer diameter than the normal pressure roller 4*b*. The thus thermally expanded thick pressure roller 4*a* is reduced in outer diameter by approximately 0.25 mm by the cooling operation performed by the fixing device 100 of the first embodiment. Further, it is understood from FIG. 8 that the fixing device 100 of the first embodiment is capable of uniformly cooling the pressure roller 4 and maintaining the difference between the maximum diameter of the pressure roller 4 at the opposed ends and the minimum diameter of the pressure roller 4 at the center with little variation in change of the outer diameter of the pressure roller 4 between the front portion, the central portion, and the rear portion.

FIG. 9 illustrates the outer diameters of five portions of the pressure roller 4, i.e., the front portion, the central portion, and the rear portion illustrated in FIG. 3 and the front end portion and the rear end portion located outside the front portion and the rear portion, respectively. The surface temperatures of the five portions were measured when the temperature in the fixing device was stabilized after continuously printing evaluation charts on A4-size sheets in an image forming apparatus including the fixing device.

In FIG. 9, a white triangle represents the measurement result of the fixing device 100*b* according to the second embodiment including the pressure roller 4 corresponding to the thick pressure roller 4*a* and the cooling device 200*b* equipped with the shielding devices 13*a* and 13*b*. A black square represents the measurement result of the fixing device 100 according to the first embodiment including the pressure roller 4 corresponding to the thick pressure roller 4*a* and the cooling device 200 unequipped with the shielding devices 13*a* and 13*b*. A black rhombus represents the measurement result of the existing fixing device including the pressure roller 4 corresponding to the thick pressure roller 4*a* and not including a cooling device. These measurement results are the outer diameters of the pressure roller 4 measured in a hot state after the above-described continuous printing. Meanwhile, a white circle represents the measurement result of the existing fixing device including the pressure roller 4 corresponding to the normal pressure roller 4*b* obtained by measuring the outer diameter of the pressure roller 4 in a cold state at a temperature of 25° C.

As illustrated in FIG. 9, the thick pressure roller 4*a* is reduced in outer diameter by approximately 0.25 mm, similarly to the results of FIG. 8, due to the cooling operation performed by the fixing device 100 of the first embodiment and the fixing device 100*b* of the second embodiment. In the first embodiment not including the shielding devices 13*a* and 13*b*, however, the front end portion and the rear end portion are unnecessarily cooled by the cooling air blown thereto, and thus are smaller in outer diameter than those of the second embodiment including the shielding devices 13*a* and 13*b*.

Accordingly, it is understood that there is less variation in change of the outer diameter of the pressure roller 4 among the front portion, the central portion, the rear portion, the front end portion, and the rear end portion, and thus that the fixing device 100*b* of the second embodiment including the shielding devices 13*a* and 13*b* is capable of more uniformly cooling the pressure roller 4 and thus suppressing the change in outer diameter of the pressure roller 4, thereby more reliably maintaining the difference between the maximum diameter of the pressure roller 4 at the opposed ends and the minimum diameter of the pressure roller 4 at the center.

As described above, a fixing device according to an embodiment of the present invention has an independent cooling mechanism for each of a front portion, a central portion, and a rear portion of a pressure roller, and is capable of controlling the amount of cooling air to be blown. Accordingly, the reduction in temperature of the pressure roller is controllable, and the difference between the maximum diameter of the pressure roller at the opposed ends thereof and the minimum diameter of the pressure roller at the center thereof is maintained irrespective of the change in outer diameter of the pressure roller due to a cooling operation.

Further, a fixing device according to an embodiment of the present invention has an independent shielding device for each of cooling units corresponding to the front portion and the rear portion of the pressure roller, to thereby blow the cooling air onto the pressure roller while reducing the amount of the cooling air to be blown onto the opposed end portions of the pressure roller. Accordingly, the opposed end portions of the pressure roller are prevented from being unnecessarily reduced in temperature, and a uniform change in outer diameter between the opposed end portions and the other portions is maintained.

Consequently, a fixing device according to an embodiment of the present invention is capable of suppressing an uneven change in outer diameter of the pressure roller due to a change in temperature occurring in a cooling operation.

Figure 10:
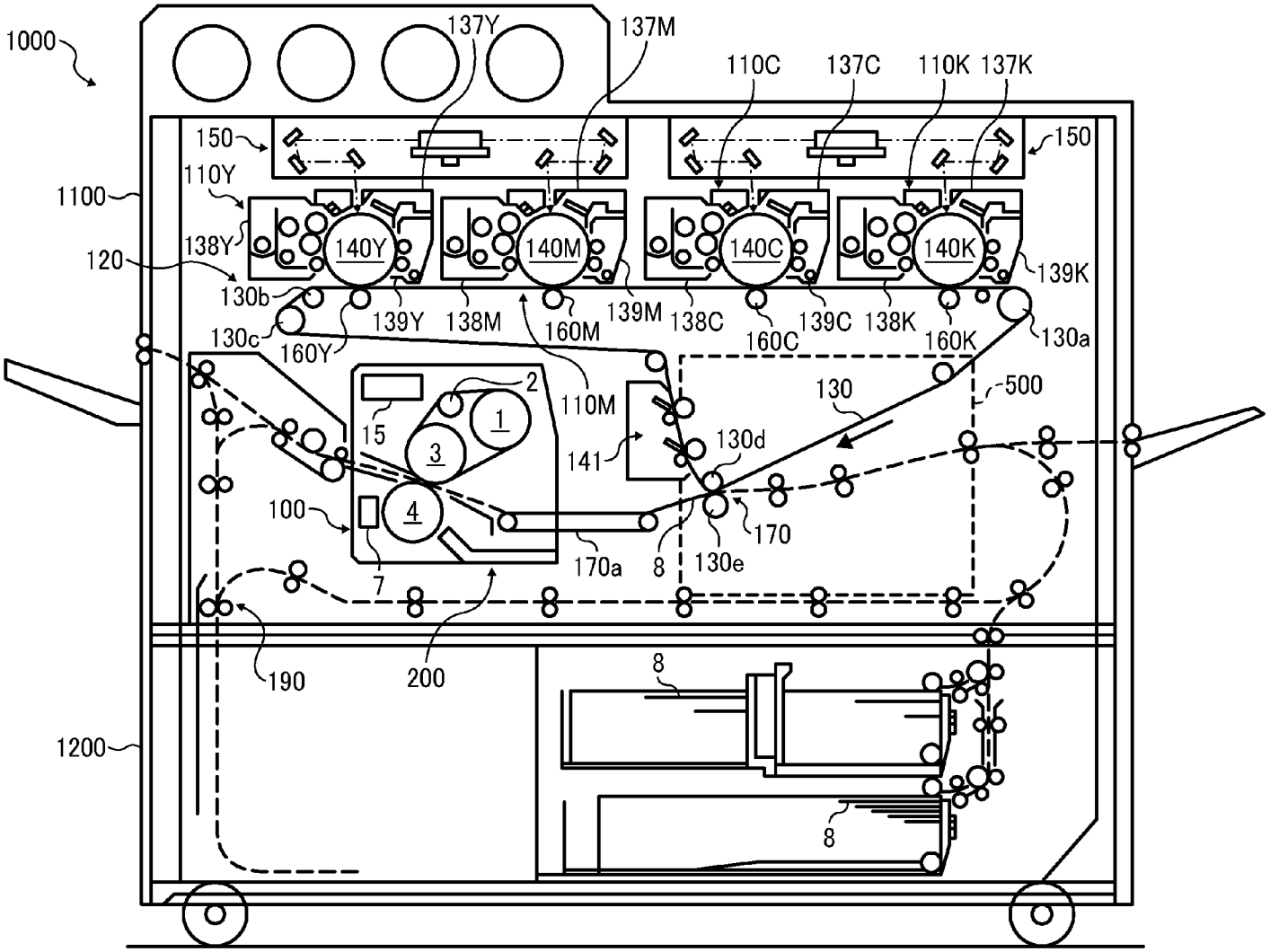
FIG. 10 is a schematic configuration diagram illustrating a front view of an image forming apparatus according to an embodiment of the present invention.

With reference to FIG. 10, an image forming apparatus 1000 according to an embodiment of the present invention will now be described. FIG. 10 is a schematic configuration diagram illustrating a front view of the image forming apparatus 1000 according to the present embodiment. FIG. 1 illustrates a tandem, intermediate-transfer image forming apparatus as the image forming apparatus 1000 according to the present embodiment. The image forming apparatus 1000 illustrated in FIG. 10 includes a main unit 1100 and a sheet feeding table 1200 holding the main unit 1100 placed thereon.

The main unit 1100 includes a tandem, intermediate-transfer image forming unit 120, an endless intermediate transfer belt 130, two exposure devices 150, the fixing device 100, a sheet reversing device 190, a control board 500, and so forth.

The tandem image forming unit 120 includes a plurality of aligned image forming devices 110Y, 110M, 110C, and 110K. The suffixes Y, M, C, and K following the reference numeral 110 represent yellow, magenta, cyan, and black colors, respectively.

The intermediate transfer belt 130 is provided at substantially the center of the main unit 1100. The intermediate transfer belt 130 is stretched around a plurality of rollers such as support rollers 130*a*, 130*b*, 130*c*, and 130*d* and configured to rotate clockwise in FIG. 10. In the illustrated example, a cleaning device 141 for cleaning the intermediate transfer belt 130 is provided on the left side of the support roller 130*d* to remove residual toner remaining on the intermediate transfer belt 130 after image transfer.

On a portion of the intermediate transfer belt 130 stretched between the support rollers 130*a* and 130*b*, the four image forming devices 110Y, 110M, 110C, and 110K are laterally aligned along the rotation direction of the intermediate transfer belt 130 to form the tandem image forming unit 120.

The image forming devices 110Y, 110M, 110C, and 110K of the tandem image forming unit 120 include photoconductor drums 140Y, 140M, 140C, and 140K for carrying toner images of the yellow, magenta, cyan, and black colors, respectively. The image forming devices 110Y, 110M, 110C, and 110K further include charging devices 137Y, 137M, 137C, and 137K, development devices 138Y, 138M, 138C, and 138K, and photoconductor cleaning devices 139Y, 139M, 139C, and 139K, respectively.

As illustrated in FIG. 10, the two exposure devices 150 are provided above the tandem image forming unit 120, with the left exposure device 150 corresponding to the two image forming devices 110Y and 110M and the right exposure device 150 corresponding to the two image forming devices 110C and 110K. Each of the exposure devices 150 consists of an optical scanning exposure device including, for example, two light source devices (e.g., semiconductor lasers, semiconductor laser arrays, or multi-beam light sources), two coupling optical systems, an optical deflector (e.g., polygon mirror) shared by the two systems, and two scanning imaging optical systems. In accordance with image information of the yellow, magenta, cyan, and black colors, the exposure devices 150 expose the photoconductor drums 140Y, 140M, 140C, and 140K to form thereon electrostatic latent images. Hereinafter, the suffixes Y, M, C, and K will be omitted where the distinction between the colors is unnecessary.

In each image forming device 110, the charging device 137 uniformly charges the photoconductor drum 140, and the corresponding exposure device 150 exposes the photoconductor drum 140 as described above to form an electrostatic latent image. Then, the development device 138 develops the electrostatic latent image with the toner of the corresponding color to form a toner image. Thereafter, the toner image is transferred to the intermediate transfer belt 130, and the photoconductor cleaning device 139 removes post-transfer residual toner remaining on the photoconductor drum 140.

At respective primary transfer positions for transferring the toner images from the photoconductor drums 140Y, 140M, 140C, and 140K onto the intermediate transfer belt 130, primary transfer rollers 160Y, 160M, 160C, and 160K are provided facing the photoconductor drums 140Y, 140M, 140C, and 140K, respectively, via the intermediate transfer belt 130.

Among the plurality of support rollers 130*a*, 130*b*, 130*c*, and 130*d* supporting the intermediate transfer belt 130, the support roller 130*a* serving as a drive roller for driving the intermediate transfer belt 130 to rotate is connected to a motor via a drive transmission mechanism including gears, pulleys, belts, and so forth.

The main unit 1100 further includes a moving mechanism that moves the support rollers 130*b* and 130*c* excluding the support roller 130*a* serving as the drive roller to separate the photoconductor drums 140Y, 140M, and 140C for the yellow, magenta, and cyan colors from the intermediate transfer belt 130 when forming a black monochrome image on the intermediate transfer belt 130.

On the opposite side of the tandem image forming unit 120 across the intermediate transfer belt 130, a secondary transfer device 170 is provided which includes a secondary transfer roller 130*e*. In the illustrated example, the secondary transfer device 170 presses the secondary transfer roller 130*e* against the support roller 130*d* via the intermediate transfer belt 130 to generate a transfer electric field on the intermediate transfer belt 130. Thereby, the toner image on the intermediate transfer belt 130 is transferred onto the recording medium 8 (i.e., transfer sheet) fed from the sheet feeding table 1200.

The fixing device 100 is provided adjacent to the secondary transfer device 170 to fix the toner image transferred to the recording medium 8. As described above, the fixing device 100 includes at least the heating roller 1, the fixing belt 2, the fixing roller 3, the pressure roller 4, the temperature gauge 7, the controller 15, and the cooling device 200. The heating roller 1 is heated by a heating device, such as a lamp or an electromagnetic induction heating device, for example. The fixing device 100 according to the first embodiment may, of course, be replaced by the fixing device 1001) according to the second embodiment.

The recording medium 8 having the toner image transferred thereto by the secondary transfer device 170 is transported to the fixing device 100 by a transport belt 170*a* supported by two rollers. The recording medium 8 carrying the unfixed toner of the toner image is fed through the nip portion formed between the fixing belt 2 heated by the heating roller 1 and the pressure roller 4 (i.e., the nip portion formed between the fixing roller 3 and the pressure roller 4 via the fixing belt 2). Thereby, the recording medium 8 is subjected to heat and pressure to fix the toner image on the recording medium 8.

The transport belt 170*a* may, of course, be replaced by a fixed guide member or transport rollers, for example. Further, in the illustrated example, the sheet reversing device 190 is provided below the secondary transfer device 170 and the fixing device 100 to extend parallel to the tandem image forming unit 120. The sheet reversing device 190 reverses and transports the recording medium 8 to record images on both surfaces of the recording medium 8.

In the image forming apparatus 1000 of FIG. 10, the control board 500 is provided on the rear side of the image forming apparatus 1000. The control board 500 includes a central processing unit (CPU), a random access memory (RAM), and a read only memory (ROM), for example, and serves as a controller for controlling the image forming apparatus 1000. In the present embodiment, the fixing device 100 includes the controller 15. Alternatively, however, the fixing device 100 may be configured not to include the controller 15, and may be controlled by the control board 500 of the image forming apparatus 1000. Still alternatively, the image forming apparatus 1000 may be connected to an external controller (e.g., an external control board or personal computer), and the cooling device 200 of the fixing device 100 may be controlled by the external controller.

The above-described embodiments and effects thereof are illustrative only and do not limit the present invention. Thus, numerous additional modifications and variations are possible in light of the above teachings. For example, elements or features of different illustrative embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. A fixing device comprising:

a heating roller;

a fixing roller;

an endless fixing belt stretched between the heating roller and the fixing roller;

a pressure roller including a core rod and an elastic layer formed on an outer circumferential surface of the core rod, and pressed against the fixing roller via the fixing belt to form a nip portion between the pressure roller and the fixing belt to thermally fix an image on a recording medium passed through the nip portion;

a plurality of temperature sensors configured to measure the surface temperature of the pressure roller; and a cooling device including a plurality of cooling units and a plurality of blowers arranged parallel to a rotation axis of the pressure roller, and to perform a cooling operation to cool the pressure roller while adjusting the amount of cooling for each of the cooling units in accordance with the surface temperature of the pressure roller measured by the plurality of temperature sensors, and to adjust an amount of cooling air blown per unit time or a duration of blowing of the cooling air in accordance with a temperature of the cooling air after blowing a constant amount of cooling air upon start of the fixing device, wherein each of the blowers includes a sensor to detect temperature or humidity of the cooling air, and wherein the cooling operation suppress uneven change in an outer diameter of the pressure roller due to the change in temperature so that the pressure roller maintains a constricted shape in a direction of the rotation axis.

2. The fixing device according to claim 1, wherein the plurality of temperature sensors are configured to measure respective surface temperatures of a plurality of portions of the pressure roller, and wherein the cooling device adjusts the amount of cooling for each of the cooling units in accordance with the surface temperatures of the plurality of portions of the pressure roller measured by the plurality of temperature sensors.

3. The fixing device according to claim 1, wherein each of the cooling units is a blow-off port through which cooling air is blown onto the pressure roller, and wherein the cooling device adjusts the amount of the cooling air to be blown for each of the cooling units in accordance with the surface temperature of the pressure roller measured by the plurality of temperature sensors.

4. The fixing device according to claim 3, wherein the plurality of temperature sensors are configured to measure respective surface temperatures of a plurality of portions of the pressure roller, and wherein the fixing device further includes a plurality of openably closable shielding devices configured to open or close in accordance with the surface temperatures of the plurality of portions of the pressure roller measured by the plurality of temperature sensors, to thereby change the amount of the cooling air to be blown from the cooling units.

5. The fixing device according to claim 4, wherein the shielding devices are disposed on the cooling units corresponding to opposed end portions of the pressure roller in the direction of the rotation axis.

6. The fixing device according to claim 1, wherein the cooling device is configured not to cool the pressure roller when the surface temperature of the pressure roller measured by the plurality of temperature sensors is lower than a predetermined temperature.

7. The fixing device according to claim 1, wherein the pressure roller includes a plurality of layers including the elastic layer, and the elastic layer is thicker than any other layer of the pressure roller.

8. The fixing device according to claim 1, wherein the constricted shaped pressure roller includes opposed end portions and a central portion, the central portion being smaller in diameter than the opposed end portions.

9. The fixing device according to claim 1, wherein the cooling device adjusts an amount of cooling air blown per unit time or a duration of blowing of the cooling air in accordance with a humidity of the cooling air measured by the sensor in the cooling unit after blowing a constant amount of cooling air upon start of the fixing device.

10. The fixing device according to claim 1, wherein the sensor is disposed inside an opening of the cooling unit or at a vicinity of an outlet of the opening of the cooling unit.

11. A fixing device comprising:

a heating roller;

a fixing roller;

an endless fixing belt stretched between the heating roller and the fixing roller;

a pressure roller including a core rod and an elastic layer formed on an outer circumferential surface of the core rod, and pressed against the fixing roller via the fixing belt to form a nip portion between the pressure roller and the fixing belt to thermally fix an image on a recording medium passed through the nip portion;

a plurality of first temperature sensors configured to measure the surface temperature of the pressure roller;

a cooling device including a plurality of cooling units and a plurality of blowers arranged parallel to a rotation axis of the pressure roller, and to perform a cooling operation to cool the pressure roller while adjusting the amount of cooling for each of the cooling units in accordance with the surface temperature of the pressure roller measured by the plurality of first temperature sensors; and to adjust an amount of cooling air blown per unit time or a duration of blowing of the cooling air in accordance with a temperature of the cooling air after blowing a constant amount of cooling air upon start of the fixing device, wherein the cooling operation suppress uneven change in an outer diameter of the pressure roller due to the change in temperature so that the pressure roller maintains a constricted shape in a direction of the rotation axis; and shielding devices disposed at opposed end portions of the pressure roller in a direction of a rotation axis.

12. The fixing device according to claim 11, further comprising a plurality of second sensors disposed at the opposed end portions of the pressure roller.

* * * * *